United States Patent [19]

Griffiths

[11] 4,064,565

[45] Dec. 27, 1977

[54] HELMET STRUCTURE

[76] Inventor: William S. Griffiths, 4425 View St., Oakland, Calif. 94611

[21] Appl. No.: 685,786

[22] Filed: May 13, 1976

[51] Int. Cl.[2] ..... A42B 3/02

[52] U.S. Cl. ..... 2/412

[58] Field of Search ..... 2/411–414; 36/71

[56] References Cited

U.S. PATENT DOCUMENTS

| | | | |
|---|---|---|---|
| 3,237,319 | 3/1966 | Hanson | 36/71 X |
| 3,407,406 | 10/1968 | Werner et al. | 2/413 |
| 3,447,163 | 6/1969 | Bothwell et al. | 2/412 |
| 3,529,306 | 9/1970 | Thorne | 2/411 |
| 3,552,044 | 1/1971 | Wiele | 36/71 |
| 3,616,463 | 11/1971 | Theodore et al. | 2/412 |
| 3,818,508 | 6/1974 | Lammers et al. | 2/412 |
| 3,946,441 | 3/1976 | Johnson | 1/412 |

FOREIGN PATENT DOCUMENTS

| | | | |
|---|---|---|---|
| 1,378,494 | 12/1974 | United Kingdom | 2/414 |

*Primary Examiner*—Alfred R. Guest
*Attorney, Agent, or Firm*—Alvin E. Hendricson

[57] ABSTRACT

A helmet is constructed with a hard surfaced, limitedly flexible shell lined with an energy absorbing material having an inner conforming liner adapted to the shape of the head or skull of a wearer for maximum comfort and safety. There may also be provided a transfer layer on the interior surface of the energy absorbing liner and formed of a flexible layer of incompressible fluid for dispersing impact forces.

5 Claims, 7 Drawing Figures

HELMET STRUCTURE

BACKGROUND OF INVENTION

Safety helmets are made in a variety of configurations, however, at least the majority of helmet designs include a stiff, inflexible outer shell and some type of interior cushioning. More advanced helmet designs incorporate some type of energy absorbing system or material at limited locations within the hard outer shell.

The stiff shell of conventional safety helmets is designed to resist blows and to remain intact thereunder so that the forces of blows are distributed over those areas of the wearer's head engaging the interior of the helmet and to this end helmet shells are commonly formed of Fiberglas or the like. Any practically dimensioned and constructed helmet shell does, however, have some upper limit of shock resistance and will physically break upon impact exceeding this upper limit. Unfortunately any helmet impact so great as to break the helmet shell allows the force of the impact to be applied to a small skull area of the user, usually with disastrous results.

The inflexible nature of conventional helmets makes the wearing thereof relatively uncomfortable. Although helmets are provided in different "hat" sizes, the helmet interior only engages the head of a wearer in a limited number of locations and is far from form fitting. This is also disadvantageous in limiting the area of a skull that must bear the force of a blow administered to the helmet thereabout so that the forces applied to the skull are concentrated on these areas.

SUMMARY OF INVENTION

The present invention provides a helmet that is not only comfortable to wear but also is safer than conventional helmets. An outer shell of the present invention is relatively hard but has a limited flexibility so as to be resiliently deformable for placing the helmet on the head and removing the helmet. Interiorly of the helmet shell hereof there is provided a conformal layer and the material thereof is adapted to "flow" into conformity with the head of a wearer of the helmet. The foregoing provides a remarkably comfortable helmet fit on the head of a wearer and in addition provides a maximized area of contact between the helmet and wearer's head so that the force of any blow applied to the helmet will be ultimately spread over the largest possible area of the skull.

The helmet of the present invention also may include a layer of energy or impact absorbing material between the interior of the helmet shell and the conformal layer. This energy absorbing material, which may be comprised of various different materials such as styrofoam beads, for example, serves to absorb the energy of a blow by deforming or crushing. Thus, a blow delivered to the helmet hereof will be transmitted through the shell to the underlying energy absorbing material whereat some portion of the energy of the blow is absorbed and the remainder is transmitted to a large area of the skull of the wearer to minimize the destructive effects thereof.

The present invention is also adapted to include a transfer layer preferably disposed internally of the energy or impact absorbing layer and serving to transfer the force of the blow substantially evenly over the entire conformal coating so as to effectively disperse the force over a large area. The transfer layer is formed of a substantially incompressible fluid or equivalent thereof and is bounded by a semirigid boundary layer on the exterior thereof so that the force of a blow that is locally applied to the outside of the layer will be transmitted for even application to a surface contacting the inside of the layer for minimizing the force per unit area applied to such surface.

DESCRIPTION OF FIGURES

The present invention is illustrated as to particular preferred embodiments thereof in the accompanying drawings wherein.

DESCRIPTION OF PREFERRED EMBODIMENTS

Figure 1:
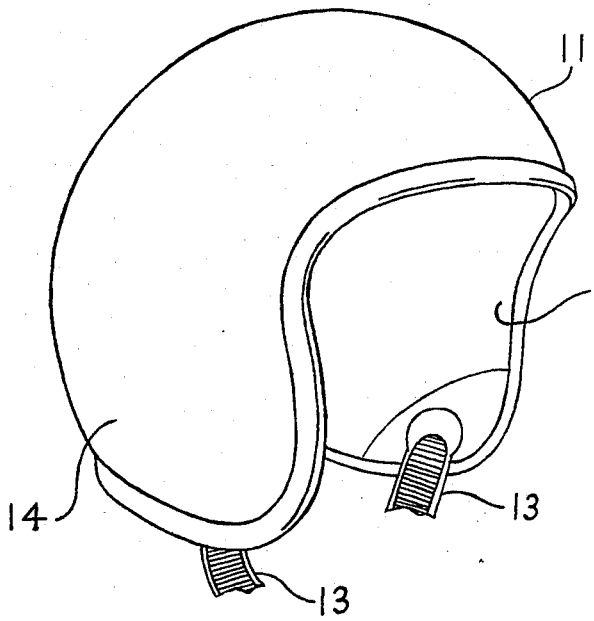
FIG. 1 is a perspective view of a helmet formed in accordance with the present invention.

The helmet structure of the present invention is particularly adapted to improve the comfort of the wearer of the helmet and at the same time to maximize the protection afforded by the helmet. In FIG. 1 of the drawings there is shown a generally conventional helmet configuration including a somewhat spherical shell 11 which may, for example, curve downwardly to cover the upper neck of the wearer and which has a front opening 12 to expose the face of the wearer. Commonly chin straps 13 are pivotally mounted interiorly of the helmet on opposite lower sides of the front opening 12.

Figure 2:
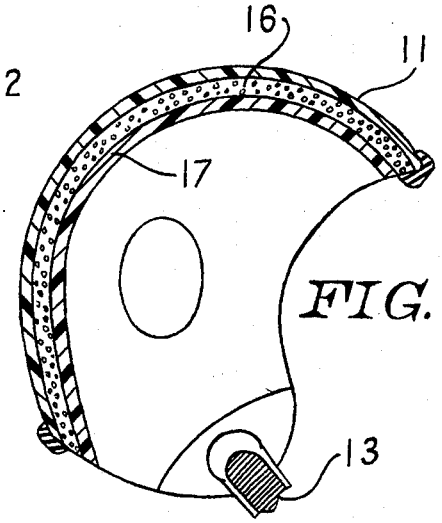
FIG. 2 is a central sectional view through the helmet of FIG. 1.
Figure 3:
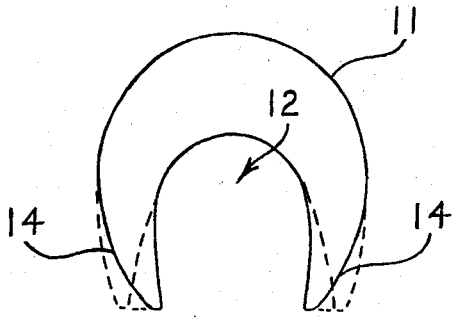
FIG. 3 is a front elevational view illustrating the limited flexibility of the helmet hereof.

Considering now the structure of the helmet of the present invention and referring particularly to FIGS. 2 and 3, it will be seen that the outer shell 11 is formed of a limitedly flexible material so that the depending side portions 14 on opposite sides of the front opening 12 near the bottom thereof may be flexed outwardly from their normal position, as indicated in FIG. 3. It will be appreciated that the normal human skull is narrower at the bottom than part way up toward the top so that an inflexible shell 11 cannot properly fit a skull because of the limited width of opening available to place the helmet on the skull. The present invention on the other hand provides a limited flexibility to the helmet shell so that the lower portions 14 may be sprung or resiliently deformed outwardly, as indicated by the dashed lines in FIG. 3, for slipping the helmet over the widest portion of the skull. This then allows the interior of the helmet to actually conform generally to the shape of a human skull or head for maximum comfort of the wearer.

Internally of the outer shell 11 of the present invention there is provided a layer 16 of impact absorbing or energy absorbing material such as foamed styrofoam, for example. Rather than provide this material only at limited locations within the helmet it is preferred herein to provide this coating 16 upon the entire interior surface of the outer shell 11 for the helmet of the present invention is not limited to touching or engaging the head of a wearer in a few points but instead is directed to engage the head of the wearer substantially over the entire surface covered by the helmet. Interiorly of the impact absorbing layer 16 there is provided in accordance with the present invention an additional layer 17. This layer 17 is designed to deform sufficiently to mold itself substantially to the contour of the head of a wearer of the helmet. The layer 17 may be formed of a thermoplastic or pressure deformable material or a combination thereof and the degree of plasticity may be varied. Suitable materials include cork particles in a matrix of petroleum gel or the like, wax particles in a suitable matrix and various other like materials. It is possible, for example, to employ material for the layer 17 that must be initially preheated as by boiling water or the like and, after surface cooling, placed on the head of an owner of the helmet who will normally wear this helmet tightly strapped to the head so that the material of the layer 17 will plastically flow to conform to the contour of the skull engaging it. A material suitable for this aplication is commercially available from Dupont under the trademark ALATHON. Alternatively, the layer 17 may be formed of a plastic material which will gradually deform under the normal heat and pressure from the head of the wearer so as to conform to the configuration of the particular head. Such a material is commercially available from the Dolomite Company under the tradename PRO-FIT. This inner layer 17 serves the purpose of fitting the head of the wearer so that the helmet is comfortable to wear and also of maximizing the contact area of the helmet to the skull of the wearer. With the helmet structure of the present invention, any blow applied to the exterior shell 11 and which is transmitted through the energy absorbing or impact absorbing layer 16 will, in fact, be applied to a substantial area of the skull of the wearer because the interior of the helmet fits the skull and engages it over substantially all of the area thereof. Conventional helmets which provide for engaging the head of the wearer only in limited areas must then apply transmitted forces to those limited areas so that there is greater danger of damage thereto.

Figure 4:
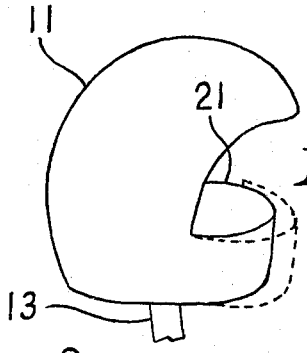
FIG. 4 is a side elevational view of a helmet in accordance with the present invention incorporating a movable face guard.

It will be appreciated that safety helmets may be formed in a variety of configurations and with a variety of attachments such as face guards, chin guards, and the like. In FIG. 4 there is illustrated a helmet in accordance with the present invention including an integral partial face guard 21 which is separated from the remainder of the helmet at one side. With this structure the face guard portion of the helmet may be deflected outward by virtue of the limited flexibility of the shell for ease of placing the helmet on the head or removing it from the head. Guard elements such as the partial face guard 21 of FIG. 4 are preferably formed of a more rigid construction than the helmet proper illustrated in FIG. 2 and described above and this may be accomplished by the inclusion of a rigid member internally of the outer shell portion with cushioning material on the inside of this rigid material.

Figure 5:
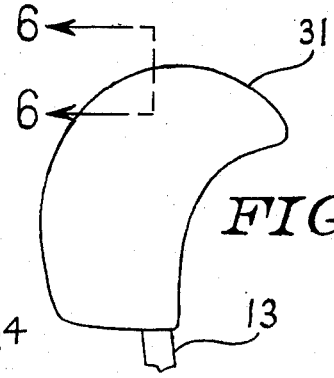
FIG. 5 is a side elevational view of an alternative embodiment of the present invention.
Figure 6:
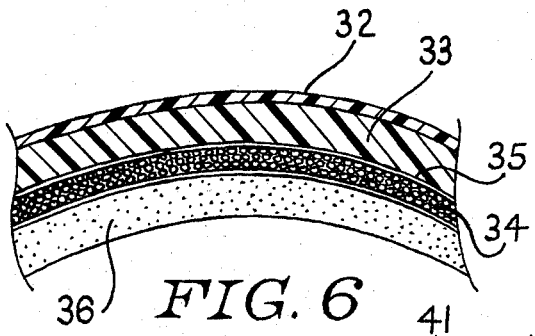
FIG. 6 is a partial sectional view taken in the plane 6—6 of FIG. 5.

The present invention may also be formed to provide even greater safety and protection and such an embodiment of the invention is illustrated in FIGS. 5 and 6. The helmet 31 of this embodiment includes a limitedly flexible shell 32 which may cover all or a portion of the skull of a wearer and which, because of its limited flexibility, may be resiliently deflected during placement of the helmet on the head of a wearer and removal of the helmet therefrom. This shell 32 is relatively hard and impervious to blows and is flexible only to the extent of allowing the helmet to be deflected for putting it on the head of a wearer and removing it therefrom. Interiorly of the limitedly flexible outer shell 32 there is provided an impact absorbing layer 33 which may, for example, be formed of styrofoam, styrofoam beads, or other suitable material. Contiguous with the interior surface of the impact or energy absorbing layer 33, there is provided a transfer layer 34 formed of a substantially incompressible fluid or gel which operates to transmit an applied force uniformly throughout the layer. A thin semi-rigid liner 35 is preferably provided between the layers 33 and 34 to limit pressure transmitted through the transfer layer from being applied back to the impact absorbing layer 33. Interiorly of the transfer layer 34 there is provided a conformal or form fitting layer 36 corresponding to the conformal layer 17 of the embodiment of the present invention illustrated in FIG. 2. This conformal layer 17 is substantially incompressible under a rapidly applied force and, in addition to those materials noted above, the layer 17 may be composed of a pressure responsive material such as LANG FLOW marketed by LANG, USA. Consequently a uniform pressure developed in the transfer layer 34 by a locally applied blow to the helmet will, in fact, be spread over a very substantial area of the skull engaging the conformal layer so as to prevent the localized application of a force that may otherwise puncture, indent or in one manner or another damage the skull. The transfer layer 34 serves to convert the force of a locally applied blow into a uniform pressure throughout the transfer layer and consequently the transfer layer should not extend over soft areas of the head of a wearer such as the face or ears. In all embodiments of the present invention it is preferable to provide indentations internally of the helmet to accommodate the ears of the wearer as it is normally uncomfortable for a wearer to have even the helmet pressure applied to the ears and it is preferable to protect the ear structure from even portions of the force of blows to which the helmet may be subject.

Figure 7:
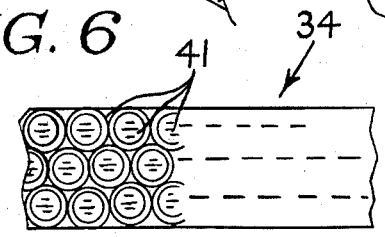
FIG. 7 is an expanded view of a transfer layer as may be incorporated in the embodiments of the present invention illustrated in FIGS. 5 and 6.

The transfer layer of the present invention as described with respect to the embodiment of FIGS. 5 and 6 may be formed of a variety of materials to generally approximate an incompressible fluid. Thus, for example, the layer 34 may be formed of a large plurality of contiguous, flexible "spheres" 41 filled with liquid, as shown in FIG. 7. These spheres may, for example, be formed into a layer by the use of a nonrigid adhesive. An individual sphere 41 may be formed of a very thin wall of flexible material completely filled with a liquid which is not flammable nor particularly volatile and which does not freeze at any temperature at which the helmet is likely to be subjected. A mass of such spheres pressed tightly together exhibits properties similar to those of a liquid, such as incompressibility, as desired in the helmet of the present invention, and yet they are much easier to form into a layer. It is furthermore noted that the transfer layer 34 is sandwiched between two other layers internally of the helmet so that the desired physical configuration of this transfer layer is at least in part maintained by the surrounding layers. It is also possible to form the transfer layer of a fluid or gel in a thin flexible envelope which is similarly restricted to the desired physical configuration by the layers on opposite sides thereof and the outer side of this envelope may be semi-rigid so as to comprise the liner 35.

The helmet structure of FIGS. 5 to 7 is employed in the same manner as the first described embodiment of the present invention illustrated in FIGS. 2 and 3. The limited flexibility of the outer shell 32 of the helmet allows the helmet to be resiliently deflected at the bottom thereof so as slip easily onto and off the head of a wearer. The outer shell 32 serves the purpose of receiving and deflecting blows which may in part be transmitted to the impact or energy absorbing layer 32 which absorbs at least a certain portion of the applied force by deflection or crushing. Such force as is transmitted to the layer 33 is somewhat diffused and upon application to the transfer layer 34 is in fact transformed into a equal pressure throughout the layer 34. The semi-rigid liner 35 causes this equalized pressure to be applied to the relatively incompressible conformal layer 36 so as to be generally uniformly transmitted therethrough to a large area of the skull of a wearer to thus preclude the application of a high intensity localized force or blow to the skull that might do injury thereto.

The present invention will be seen to provide a practical and substantial improvement in safety helmets. Not only is a helmet formed in accordance with the present invention more comfortable to wear but also such a helmet affords an additional degree of safety, first because of the better and enlarged contact of the interior of the helmet with the skull of the wearer and in the second embodiment of the present invention, because of the efficient conversion of the localized force to an even pressure over a substantial area. Although the present invention has been described with respect to only specific embodiments thereof, it will be appreciated by those skilled in the art that modifications and variations are possible within the true scope of the present invention and thus it is not intended to limit the invention to the precise terms of description or details of illustration.

What is claimed is:

1. An improved helmet structure comprising a limitedly flexible outer shell having the shape of the head of a person and adapted for deflection adjacent the opening therein so as to fit over the head of a person, a conformal layer of a slowly conforming thermoplastic or pressure deformable material within said shell disposed on a substantial area of the interior surface of said shell for conforming to the physical configuration of the skull of a wearer of the helmet in physical engagement with a substantial portion of such skull, an impact absorbing layer disposed between said shell and said conformal layer and extending over a substantial area of the interior of said shell and a transfer layer of substantially incompressible fluid or gel disposed between said impact absorbing layer and said conformal layer and having a thin semirigid liner adjacent said impact absorbing layer for applying a substantially uniform pressure over the surface of said conformal layer upon the application of a force to the transfer layer from said energy absorbing layer.

2. An improved helmet structure comprising a limitedly flexible outer shell having the shape of the head of a person and adapted for deflection adjacent the opening therein so as to fit over the head of a person, a conformal layer of a slowly conforming thermoplastic or pressure deformable material within said shell disposed on a substantial area of the interior of said shell for conforming to the physical configuration of the skull of a wearer of the helmet in physical engagement with a substantial portion of such skull, an impact absorbing layer disposed between said shell and said conformal layer and extending over a substantial area of the interior of said shell and a transfer layer of a substantially incompressible flowable material disposed between said impact absorbing layer and said conformal layer.

3. The helmet structure of claim 2 further defined by the material of said transfer layer comprising a plurality of contiguous liquid filled flexible spheres.

4. An improved helmet structure comprising a limitedly flexible exterior shell having a continuous front and bottom opening that is narrower than the interior of the shell and being resiliently deformable thereat for fitting over the head of a wearer to close thereabout, a first layer of impact absorbing material disposed on the inner surface of said outer shell and extending over substantially all of the interior surface thereof, a transfer layer disposed on said first layer within said shell and comprising a substantially incompressible nonsolid deformable material which converts an applied force to an equal pressure therethrough, and an inner conformal layer disposed on said transfer layer and formed of a material that is slowly deformable and substantially incompressible by rapidly applied forces adapted to conform to the shape of the skull of a wearer of the helmet so as to contact at least a substantial area of such skull.

5. The structure of claim 4 further defined by a thin semi-rigid liner between said impact absorbing layer and said transfer layer.

* * * * *